United States Patent [19]

Kappel et al.

[11] 4,440,334

[45] Apr. 3, 1984

[54] ADJUSTABLE CAMERA STRAP CONSTRUCTION

[75] Inventors: Joseph Kappel, Hewlett; Richard Goldberg, Scarsdale, both of N.Y.

[73] Assignee: Coast Manufacturing Co., Inc., Mt. Vernon, N.Y.

[21] Appl. No.: 491,845

[22] Filed: May 5, 1983

[51] Int. Cl.[3] ..... A45F 5/00

[52] U.S. Cl. ..... 224/258; 224/202; 224/268; 224/908

[58] Field of Search ..... 224/258, 255, 268, 202, 224/205, 252, 269, 908, 150; 24/3 J, 3 K, 3 L, 24/3 M, 231, 265 EC, 237; D2/422

[56] References Cited

U.S. PATENT DOCUMENTS

| | | | |
|---|---|---|---|
| 2,652,050 | 9/1953 | Schoeller | 224/268 X |
| 3,201,017 | 8/1965 | Morrissey | 224/202 |
| 3,543,976 | 12/1970 | Ronald | 224/205 X |
| 3,559,853 | 2/1971 | Strassman | 224/908 X |
| 4,125,211 | 11/1978 | Handsman | 224/908 X |

*Primary Examiner*—Steven M. Pollard

*Attorney, Agent, or Firm*—Wolder, Gross & Yavner

[57] ABSTRACT

An improved adjustable camera strap construction to support a hand-held camera from the back and shoulders. The shoulder strap is slidably received within the slot of a belt hook. A swivel is secured to the other end of the belt hook, and carries a latch which detachably engages a standard camera mounting post.

2 Claims, 2 Drawing Figures

ADJUSTABLE CAMERA STRAP CONSTRUCTION

The present invention relates to a new and improved camera strap construction, and more specifically is directed to improved adjustable camera strap construction used to support a hand-held camera utilizing the back and shoulders of the user.

Almost since the development of hand-held cameras, and particularly as cameras became heavier, it has been desirable to provide a means for carrying the camera on the body without constantly holding it in one's hand. Generally, cameras are sold with a thin leather strap having a widened adjustable portion where the strap engages the neck or shoulders of the user. This has generally been found to be unsatisfactory, and over the years a market has developed in which wide straps are sold, the straps being designed for securement to the standard mounting posts of most cameras. These straps are widely used for 35 millimeter format SLR cameras, the standard 2×4 cameras, and other such units. They are particularly helpful when long distances lenses are used. These lenses tend to be very long, and were the user just to utilize the strap provided by the camera manufacturer, it would soon dig into the shoulders and back, causing discomfort.

In the past, the straps have been attached to a non-woven fabric hook member. One end is attached to the strap and the other end is attached to swivel support and standard latch hook. It has been found that these non-woven fabric support members tend to tear easily and eventually through repeated use will shear or otherwise disintegrate long before the strap has outlived its usefulness.

It is therefore an object of the present invention to provide an improved adjustable camera strap construction.

Another object of the present invention is to provide a construction which will consist of a belt hook that will not fall into disuse before the strap or the latch hook.

Still another object of the present invention is to provide an improved construction which will allow all the flexibility of the prior art construction and yet will be capable of withstanding much greater periods of wear and tear.

Yet a further object of the present invention is to provide an improved construction which is simple and economical to manufacture and yet which will be durable and long lasting to a high degree of use.

The improved adjustable camera strap construction of the present invention includes a standard shoulder strap having means adjustably secured to the strap to vary its length in accordance with the particular physique of the user. The strap has a floating end at one point which is slidably received in an opening of a belt hook. The other end of the belt hook narrows down to a support platform for a swivel to which is attached a standard latch hook. A similar unit is secured to the other end of the strap, except that instead of having a floating end, the belt has a fixed end.

The belt hook itself is formed of any rigid strong material, such as metal, and may be die stamped or moulded out of a high impact plastic. The hook has an opening at one end to receive the belt strap, and at the other end it has a narrowed portion which is flatened and has a bore therein to receive the head of a standard swivel. The head is flattened to prevent removal of the swivel, and the eyelet of the swivel receives a standard latch hook having a spring-loaded arm, the hook having a sufficient width to allow it to engage the posts of a hand-held camera.

The above brief description, as well as further objects and advantages of the invention, will be more fully appreciated with reference to the following detailed description of a preferred, but nonetheless illustrative embodiment of the invention, when taken in conjunction with the following drawings, wherein.

Figure 1:
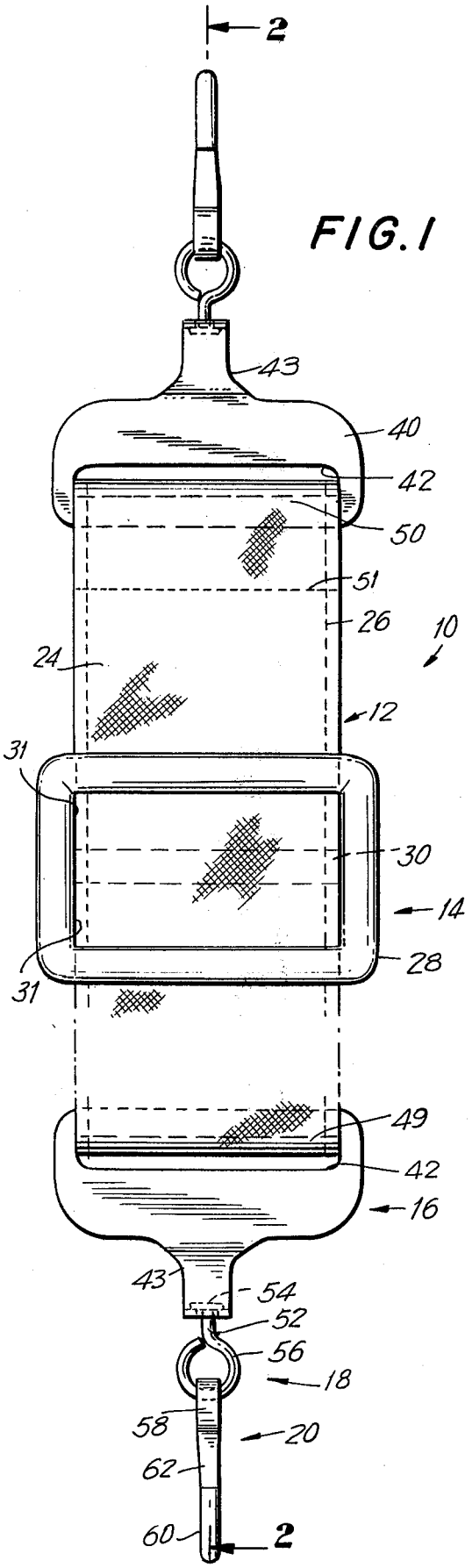
FIG. 1 is a plan view of a camera strap construction.

Referring to the drawings, there is shown an improved adjustable camera strap construction 10 broadly comprising a strap 12, an adjustable lock 14, a belt hook 16, and a swivel 18 and latch hook 20.

Turning more particularly to the strap 12, it is made of standard Velcro-type material which includes a standard fabric 22 with a reverse fabric 24. The fabric 24 is the material from which the broken hooks are formed, but in this case the fabric has not been cut to form the hooks and is in its standard weaving state with regular loop stitching. The unit is sewn together by a line of stitching as at 26 in the standard manner. The use of this fabric is standard now in the industry since it allows a number of items to be easily detachably secure to the strap. Such items might include extra containers for the film, etc.

The lock 14 is a standard adjustable lock and has a rectangular frame 28 with a center post 30, defining two slots 31.

Figure 2:
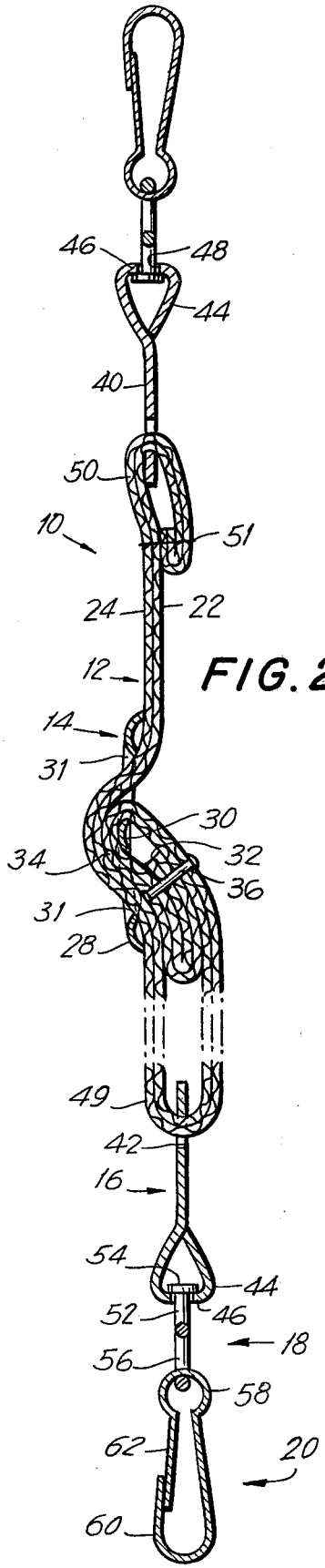
FIG. 2 is a cross-sectional view taken along the line 2—2 of FIG. 1.

As can be seen in FIG. 2 one end of the fabric 32 is doubled over as at 34 and is held in place by rivets 36, the fabric passing around the center post 30. The free end of the strap then moves through the slots 31 and the belt is adjusted by tension in the well known fashion.

Turning to the belt hook, there is seen a rectangular frame 16 having a slot 42 in one end, the slot is wide enough to receive the belt to allow it to freely slide therethrough at one end and to be attached at the other end. The other end of the hook narrows as at 43 to form a doubled back triangular finger 44 having a flat portion 46 which is perpendicular to the main body portion of the hook 40. There is a hole 48 defined in the portion 46.

As can best be seen in FIG. 2 there is a rounded portion of the belt which is received in the lower belt hook and defines a constantly varying end portion 49. The other end 50 is the other end of the belt, and is doubled over on itself and held after passing through the slot 42, and is held into position by stitching 51 or the like.

Turning to the swivel there is defined a standard post 52 passing through the hole 48 and with a flat head 54 to keep the swivel in position. Because it is loosely received within the hole 48, it can turn at will. The other end of the swivel defines a standard eyelet 56.

The latch 20 has a rounded end 58 which passes through the opening defined by the eyelet in the standard manner, and then expands outwardly with a lower hook portion 60 against which is positioned a flexible spring-loaded arm 62, also in the well known fashion, The belt hook 16 is clearly a significant structural advance over the non-woven fabric used in such constructions. The user no longer has to get rid of the unit when the non-woven strap tears or otherwise becomes unusable. The metallic or high impact plastic belt hook is probably capable of outlasting the normal life of the shoulder strap. The design allows easy movement of the swivel latch hook and thus provides all of the advantages of the prior art construction, without any of the disadvantages.

As can be seen the present invention provides significant advance over the state of the technology. As numerous changes and modifications in construction can be performed within the scope of the invention, such scope is to be measured by the claims herein.

What is claimed is:

1. An improved adjustable camera strap construction which comprises:

(a) a shoulder strap;

(b) means adjustably secured to said strip to accommodate the length thereof in accordance with the particular physique of the user;

(c) at least one belt hook made of a rigid durable material, receiving said strap at one end; and (d) said belt hook carrying a latch having means to detachably engage a standard mounting post of a camera body, said hook has an opening defined at one end thereof for receiving said strap, and a narrowing portion at the other end, said narrowing portion forming a triagular finger having an opening defined in a flat portion thereof, said flat portion being perpendicular to the main body of said hook, said opening receiving said latch, whereby the belt hook will durably secure the strap to the latch hook during the useful life of the construction.

2. The invention according to claim 1, at least two hooks secured to said strap.

* * * * *